US006120164A

United States Patent [19]

Libin et al.

[11] Patent Number: 6,120,164

[45] Date of Patent: Sep. 19, 2000

[54] MULTIPLE LAMP LIGHTING FIXTURE

[75] Inventors: Charles Libin, Brooklyn, N.Y.; David W. Skutch, Montclair, N.J.; Lawrence Lieberman, Hartsdale, N.Y.

[73] Assignee: Luminaria Ltd., New York, N.Y.

[21] Appl. No.: 09/198,553

[22] Filed: Nov. 23, 1998

Related U.S. Application Data

[60] Provisional application No. 60/066,948, Nov. 25, 1997.

[51] Int. Cl.[7] ..... F21V 21/26

[52] U.S. Cl. ..... 362/269; 362/33; 362/227; 362/250; 362/270

[58] Field of Search ..... 362/11, 43–54, 362/236–240, 269, 287, 427, 428, 33, 232, 233, 371, 372, 250, 399, 400, 420, 37, 57–59, 60, 227, 270

[56] References Cited

U.S. PATENT DOCUMENTS

| | | | |
|---|---|---|---|
| D. 214,188 | 5/1969 | Lauterbach | D48/20 |
| D. 315,801 | 3/1991 | Luger | D26/24 |
| D. 336,146 | 6/1993 | Yamada et al. | D26/65 |
| 1,335,832 | 4/1920 | Harvey . | |
| 1,909,947 | 5/1933 | Greppin | 362/275 |
| 1,941,503 | 1/1934 | Villiers | 240/1.2 |
| 1,960,534 | 5/1934 | Gibney | 240/3 |
| 2,134,551 | 10/1938 | Enfield | 240/41.35 |
| 2,411,935 | 12/1946 | O'Farrell | 240/48 |
| 3,110,815 | 11/1963 | Sturm | 250/217 |
| 3,887,801 | 6/1975 | Ilzig et al. | 362/33 |
| 4,025,777 | 5/1977 | Hayakawa | 240/1.4 |
| 4,205,778 | 5/1977 | Hayakawa | 240/311 |
| 4,288,844 | 9/1981 | Fisher et al. | 362/33 |
| 4,316,237 | 2/1982 | Yamada et al. | 362/33 |
| 4,519,021 | 5/1985 | Oram | 362/277 |
| 4,591,953 | 5/1986 | Oram | 362/33 |
| 4,803,607 | 2/1989 | Jonsson | 362/250 |
| 5,473,523 | 12/1995 | Von Fange | 362/232 |
| 5,580,163 | 12/1996 | Johnson, II | 362/285 |
| 5,951,139 | 9/1999 | Smith et al. | 362/33 |

*Primary Examiner*—Sandra O'Shea
*Assistant Examiner*—Ismael Negron
*Attorney, Agent, or Firm*—Ostrager Chong & Flaherty

[57] ABSTRACT

A lighting fixture having a plurality of adjustable lamps provides multiple beams of light which may be simultaneously converged or focused at substantially any distance in front of the fixture or diverged to produce a broad flood. The fixture comprises a focusing mechanism for simultaneously controlling the axial position of a central lamp and the inclination of a plurality of outer lamps tightly clustered and arranged around the central lamp.

21 Claims, 7 Drawing Sheets

MULTIPLE LAMP LIGHTING FIXTURE

This application claims benefit of Provisional Application Ser. No. 60/066,948 filed Nov. 25, 1997.

FIELD OF INVENTION

This invention relates to an adjustable, multiple lamp lighting fixture and, more particularly, to a lighting fixture having multiple beams of light which may be converged or focused at substantially any distance in front of the fixture or diverged to produce a broad flood.

BACKGROUND OF INVENTION

Lighting fixtures having multiple lamps are generally known in the prior art for use in a variety of industries. In the entertainment industry, such lighting fixtures generally comprise a plurality of individual sealed beam PAR-type lamps placed in close proximity with each other and either set to a certain focus, made independently adjustable or made adjustable in groups. The individual lamps are usually arranged in a grid pattern comprising vertical and horizontal rows of lamp housings. Focusing the lamps may be achieved by individually panning and tilting the vertical and horizontal lamp rows, thereby providing rows of light which converge only on latitudinal and/or longitudinal planes dictated by the distance between the vertical and horizontal lamp rows. An example of a grid-type lighting fixture is shown in U.S. Pat. No. 5,473,523 to Von Fange, which discloses a plurality of lamps mounted on a movable platen such that the beam angle of all lamps may be simultaneously adjusted in the same direction to the same angle.

The inability of grid-type multiple lamp lighting fixtures to simultaneously focus the beam centers of each lamp on one point results in wasted foot candles and lacks efficiency. Even if the lamps are independently adjustable, it is difficult and time consuming to determine whether the lamps are focused on one point. Turning on a center lamp, projecting it onto a point and locking the pan and tilt positioning of the entire fixture also does not guarantee that the remaining lamps will be focused on the central point because there is no mechanism that maintains a constant relationship between all of the lamps.

Multiple lamp lighting fixtures of other configurations are also known in the art. For example, lighting fixtures having a plurality of lamps concentrically mounted around a central axis to pivot toward the axis are commonly used in the medical industry and are shown in U.S. Pat. Nos. 3,887,801 to Ilzig et al., 4,316,237 to Yamada et al. and 4,591,953 to Oram. U.S. Pat. No. 2,134,551 to Enfield shows a light projecting device having a fixed central lamp surrounded by a ring of lamps which may be adjustable. These patents show many different mechanical devices incorporated into lighting fixtures which adjust the inclination or angle of outer lamps to focus light beams at varying distances. However, the prior art has failed to provide a multiple lamp lighting fixture having a plurality of lamps concentrically mounted and pivotally hinged to a movable center hub or the preferred pivoting mechanism of this invention which provides simultaneous axial movement of a center hub and pivoting of the outer lamps. Such a lighting fixture is needed in the art to provide the convenience of an energy-efficient lighting fixture having a broad range of uses.

Moreover, prior art multiple-lamp lighting fixtures offer no provisions for mounting wire scrims or other devices which control the light output from a fixture without adversely affecting it. Wire scrims have been commonly used in the entertainment industry on single lamp lighting fixtures. The intensity of light emitted from known multiple-lamp lighting fixtures is generally controlled by varying the input voltage and/or selectively turning on or off individual lamps. However, adjusting the input voltage to the fixture often shifts the color temperature of the light emitted from the lamp (when measured in Kelvin units). Turning on or off individual lamps may also adversely affect the desired shape of the projected beam pattern.

It is therefore a broad object of this invention to provide an improved multiple lamp lighting fixture which may be used in a broad range of industries including entertainment, medicine, construction, emergency and other industrial applications.

A more specific object of the invention is to provide an energy efficient, multiple lamp lighting fixture capable of maximizing total light output from the fixture by simultaneously focusing the beam centers of all individual lamps onto one point anywhere along a central axis.

Another object of the invention is to provide a simple focusing mechanism that maintains a constant relationship between all lamps and permits all lamps to be adjusted in unison.

A still further object of the invention is to provide a multiple lamp lighting fixture having provisions for controlling light output without adversely affecting the color temperature of the light and without changing the shape of the projected light beam.

SUMMARY OF THE INVENTION

In the present invention, these purposes, as well as others which will be apparent, are achieved generally by providing a lightweight, but sturdy tubular frame for housing a plurality of high intensity lamps closely arranged around and pivotally connected to a movable center hub, which may contain a center lamp, such that when the center hub is moved along its center axis, all concentric lamps simultaneously tilt toward the same axis. The invention improves upon known multiple lamp light fixtures by incorporating an easy to use focusing mechanism for simultaneously adjusting the horizontal axial position of the center hub and the tilt angle of all concentric lamps, thus maintaining a constant relationship between all of the lamps.

Advantage lies in the ability to focus a plurality of high intensity lamps on a point from sixteen inches or less to several hundred feet in front of the fixture, thereby preventing wasted foot candles. When narrow spot bulbs are used, the fixture can focus on subjects at great distances. A flood pattern may also be produced by completely retracting the center hub such that the beams of each lamp criss-cross or by using wide bulbs. Further advantage lies in the ability to utilize light output accessories commercially available for single lamp fixtures.

In a preferred embodiment, the multiple lamp lighting fixture comprises a plurality of lamps arranged within a common housing such that a central lamp having a central beam axis is surrounded by and pivotally linked through a central hub to a plurality of outer lamps each having an outer beam axis, the outer lamps being pivotally linked to the housing, and a focusing means for simultaneously moving the central lamp in a direction parallel to the central beam axis and causing each of the outer lamps to pivot such that each outer beam axis may be converged on a point along the center beam axis. The housing comprises an open tubular frame which provides ventilation and easy access to the plurality of lamps which may be individually rotated to adjust the beam pattern. The lighting fixture further comprises means for removably securing standard light output accessories to a front surface of the housing.

The focusing means comprises a cylindrical drive can having a plurality of pins extending from its surface, a first cylindrical guide means mounted to a rear surface of the housing and a second cylindrical guide means mounted to the central lamp, the first and second guide means each having a plurality of latitudinal slots therethrough, the slots in the first guide means being perpendicular to the central beam axis and the slots in the second guide means being inclined with respect to central beam axis, wherein the drive can is arranged to revolve in the inner surfaces of the first and second guides and the pins on the surface of the drive can are arranged to slide in the latitudinal slots. The slots in the first guide means maintain a fixed linear relationship between the drive can and the central lamp such that the slots in the second guide means can provide motive force for moving the combination drive can and central lamp along the central beam axis. Rotation of the drive can is controlled by turning a focusing handle on a rear surface of the drive can. The position of the drive may be locked in place after the lamps have been focused to prevent inadvertent rotation of the drive can.

Other objects, features and advantages of the present invention will be apparent when the detailed description of the preferred embodiments of the invention are considered in conjunction with the drawings which should be construed in an illustrative and not limiting sense, as follows:

DESCRIPTION OF PREFERRED EMBODIMENT

Figure 1:
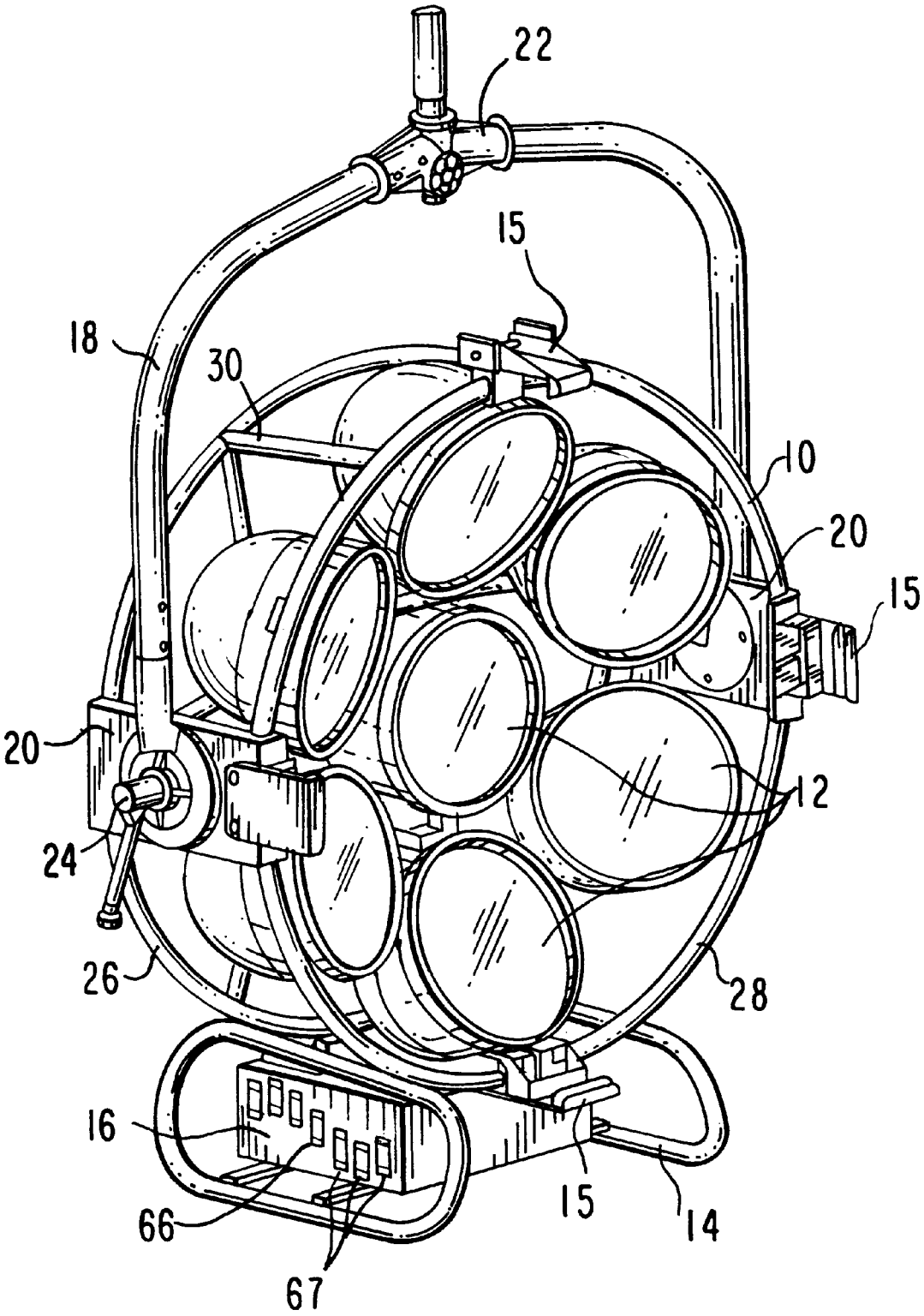
FIG. 1 is a concept drawing showing a perspective view of the multiple lamp lighting fixture in accordance with a preferred embodiment of the invention.
Figure 2:
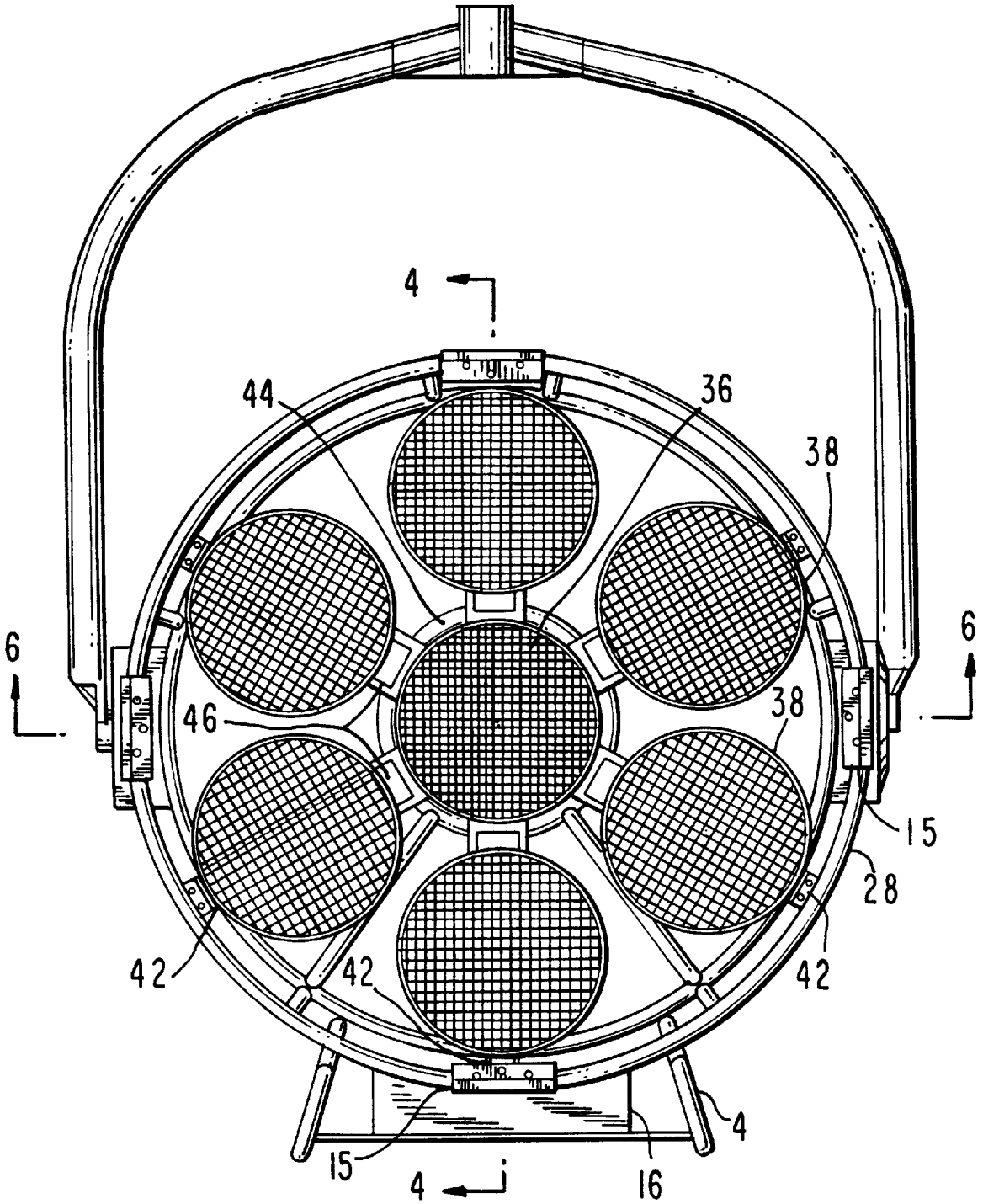
FIG. 2 is a front plan view of a multiple lamp lighting fixture in accordance with a preferred embodiment of the invention.

Referring now to the drawings, FIGS. 1–6 show a multiple lamp lighting fixture according to a preferred embodiment of the present invention which has particular application in the entertainment industry including, without limitation, the television, motion picture, theater and concert industries.

Referring to FIG. 1, the fixture comprises a main frame 10 for housing a plurality of adjustable lamp housings 12 which is supported by a longitudinal frame base 14. An electrical switch box 16 for controlling the voltage supplied to the lamps housing 12 is mounted in the frame base 14. Accessory holders 15 are provided for removably securing to the fixture commercially available accessories for modifying the light output from the fixture. The ends of a conventional U-shaped yoke 18 are pivotally connected to opposing sides of the main frame 10 by mounting plates 20. A mounting bracket 22 is provided in the center of the yoke 18 for attachment to either an overhead or floor based support structure (not shown). The yoke 18 is large enough to swing completely around the fixture for easy handling. Universal positioning of the fixture may be achieved by panning the supporting structure from side to side and by tilting the main frame 10 in mounting plates 20. The main frame's tilt position may be locked in place by rotating a removable locking arm 24.

Figure 3:
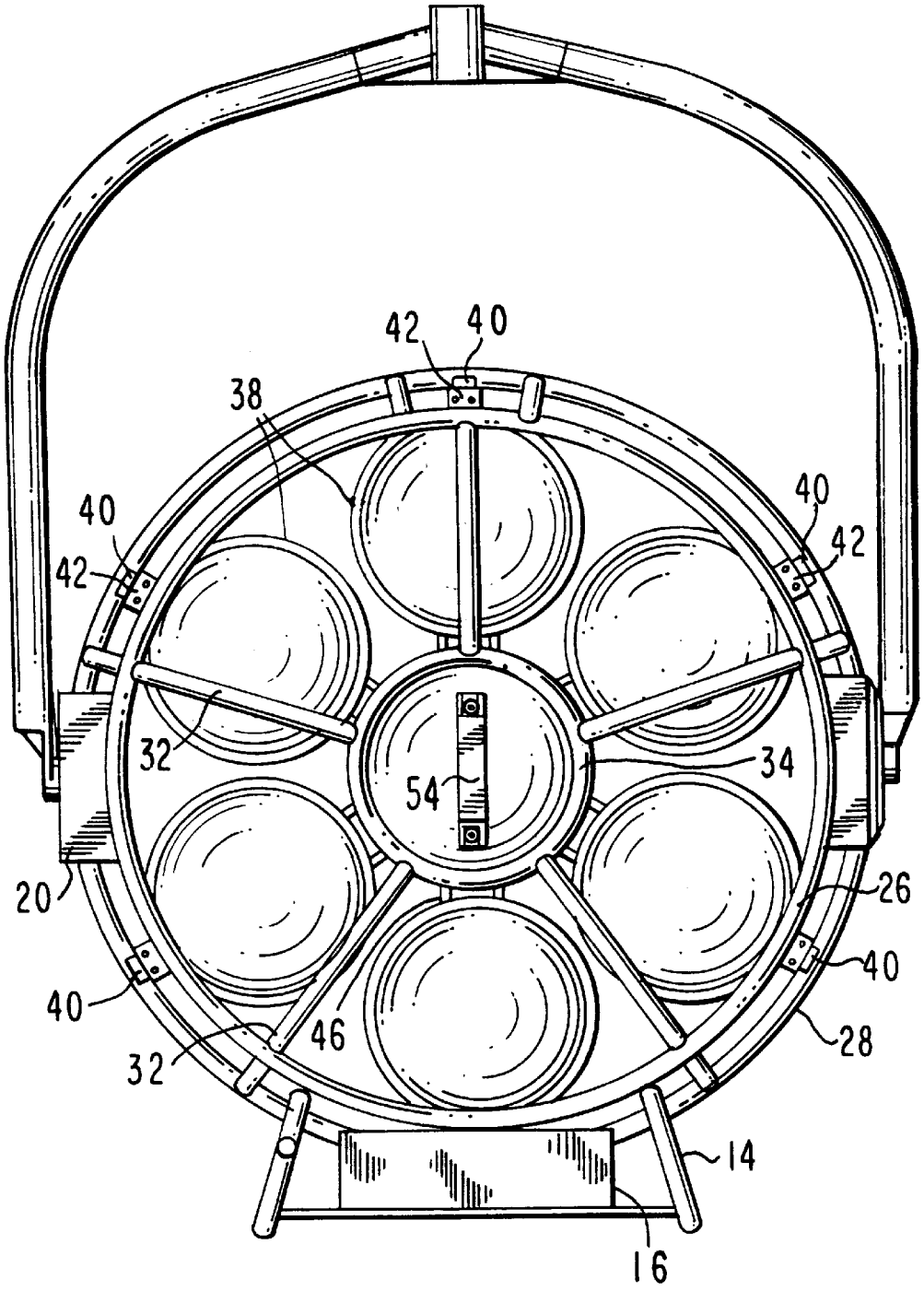
FIG. 3 is a rear plan view of a multiple lamp lighting fixture in accordance with the preferred embodiment of the invention shown in FIG. 2.
Figure 5:
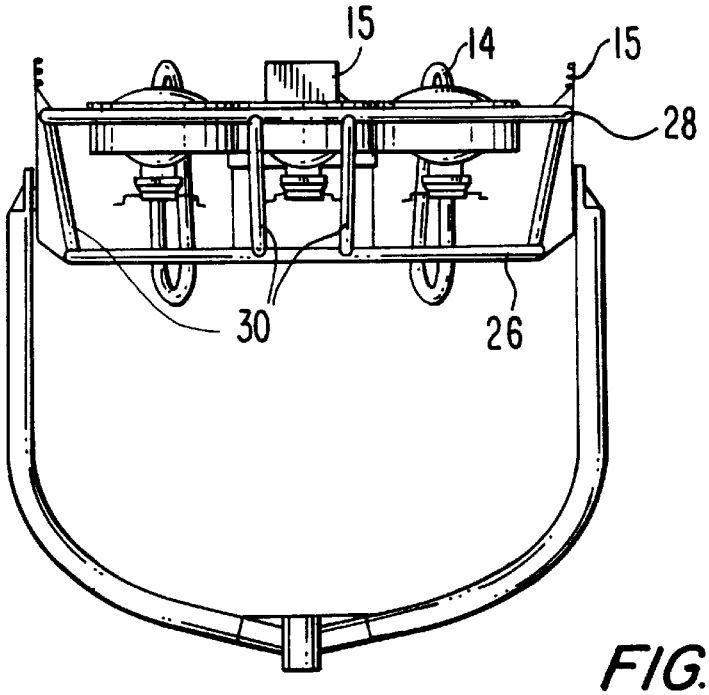
FIG. 5 is a top plan view of a multiple lamp lighting fixture in accordance with the preferred embodiment of the invention shown in FIG. 2.
Figure 6:
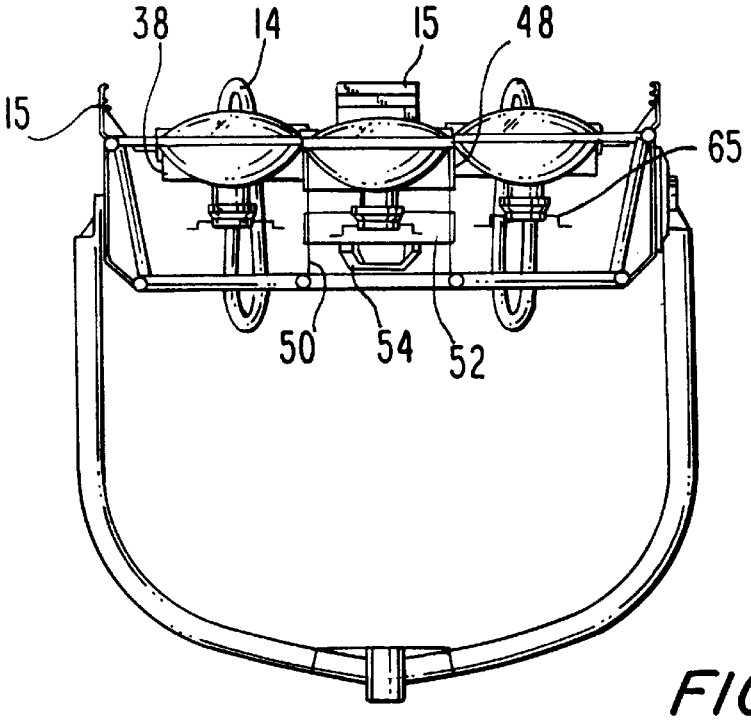
FIG. 6 is a cross-sectional view of a multiple lamp lighting fixture in accordance with the preferred embodiment of the invention taken along the lines 6—6 of FIG. 2.

As best shown in FIGS. 1 and 5, the main frame 10 comprises a pair of spaced apart concentric rear and front tubular members 26, 28 connected to each other around their periphery via a series of perpendicular tubular shafts 30. Referring to FIG. 3, the rear tubular member 26 comprises outer 26 and inner 34 concentric tubular members arranged in a coaxial formation and connected to each other via a series of main spokes 32. The open nature of the tubular frame 10 provides easy access to the interior of the lighting fixture for lamp adjustment and replacement, and further provides improved ventilation and lamp cooling. The frame base 14 comprises a pair of longitudinal tubular support members configured to be joined to the outer radial edges of the main frame's rear and front tubular members 26, 28 and to support the fixture in an upright position on a flat surface. The frame base 14 may be reinforced with runners to reduce bottom wear. All tubular components of the main frame 10 and frame base 14 are made from thick-walled aluminum tubing. However, any sturdy, lightweight material, such as stainless steel or other alloys, may be used.

In a preferred embodiment, seven hollow, cylindrical lamp housings 12 are arranged in the main frame 10 to accommodate seven lamps. The lamps housings 12 are arranged in a tight cluster comprising a central lamp housing 36 and six outer lamp housings 38. The lamp housings are mounted in the main frame such that the central lamp housing simultaneously moves in a plane parallel to its center axis and controls the tilt angle of the outer lamps.

The outer lamp housings 38 are linked together through the center lamp housing 36. Each outer lamp housing 38 is, on one side, pivotally mounted to a mounting block 40 on the inner edge of the main frame's front tubular member 28 through outer housing hinges 42. The outer housing hinges may be of any type which allow the outer housings to tilt in the plane perpendicular to the plane of the main frame's front tubular member. At least one of the outer housing hinges should be a friction or torque type hinge to prevent unwanted movement. The opposing side of each outer lamp housing 38 is pivotally linked to a center drive assembly 44 through center housing hinges 46. The center housing hinges 46 are lever-type hinges comprising two arms 46*a*, 46*b* connected by a central pin 46*c*. One arm 46*a* is fixed to the outer surface of each outer lamp housing 38 and the other arm 46*b* is pivotally mounted through a second pin 46*d* to the center drive assembly 44. This type of hinge allows the center lamp housing 36 to move in a direction parallel to its beam axis and simultaneously adjust the tilt angle of the outer lamp housings 38.

Referring to FIGS. 4A, 4B, 7A and 7B, the center drive assembly 44 comprises the center lamp housing 36, a center housing hub 48 attached to the outer circumference of the central lamp housing 36, a guide ring 50 and a center drive can 52, all having a cylindrical configuration. The center housing hinges 46 are each mounted to the center housing hub 48. The guide ring 50 is mounted to the inner concentric tubular member 34 of the rear tubular member 26 and comprises a thin plastic material having a low coefficient of friction. One end of the center drive can 52 is mounted to the center housing hub 48 and the other end is placed in the guide ring 50 such that it may be freely rotated by focusing handle 54 at the rear of the center drive can 52. Rotating the center drive can causes it to move in an axial direction and simultaneously adjust the tilt angle of the outer lamp housings, thereby focusing the light output from the fixture.

Axial movement of the center drive can 52 and tilting of the outer lamp housings 38 is achieved by a series of pins adapted to project through and slide in a series of concentric slots in the center drive assembly 44. The central lamp housing 36 and the guide ring 50 each comprise a plurality of latitudinal slots 58, 56 cut in and around their peripheries, preferably two slots on opposing sides. The latitudinal slots 56 in the guide ring are cut on an angle or bias for the purpose of providing motive force in the axial direction. Short inner 60 and outer 62 guide pins project from the outer surface of the center drive can 52 and are arranged to slide in the latitudinal slots 56, 58. Rotating the center drive can 52 causes the pins 60, 62 to move inside the slots 56, 58. Since the latitudinal slot 58 in the central lamp housing 36 is arranged in the direction of rotation, the center drive can 52 is retained in a fixed, linear relationship with respect to the central lamp housing 36 and center housing hub 48. The slant in the slot 56 in the guide ring 50 therefore causes both the center drive can 52, the central lamp housing 36 and center housing hub 48 to move in the axial direction. This arrangement provides for a smooth and precise light adjustment.

Figure 4B:
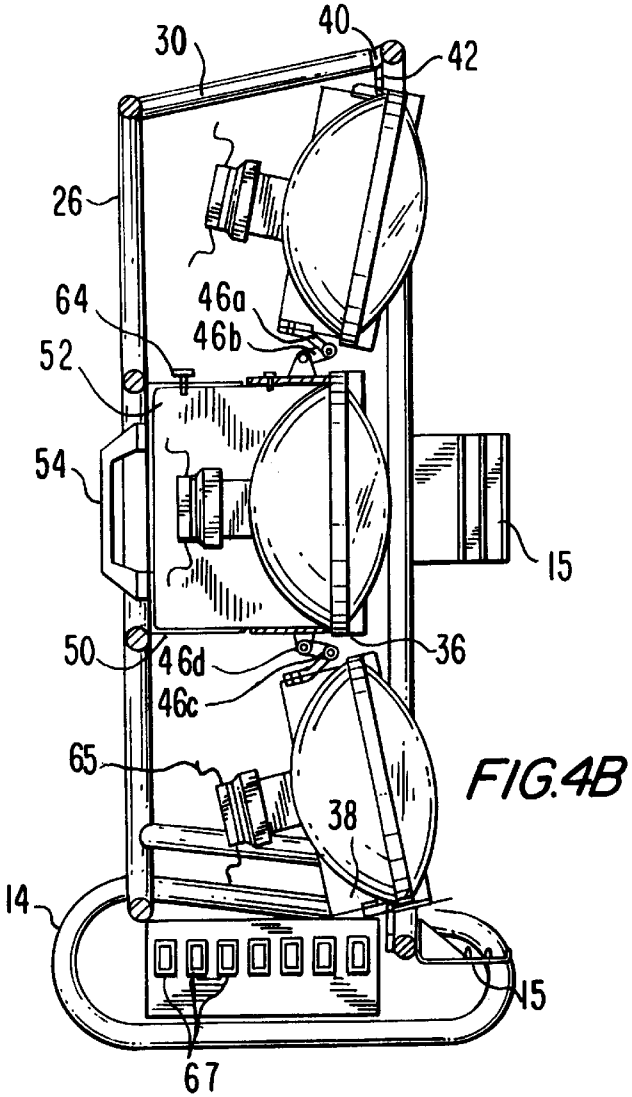
FIGS. 4A and 4B are cross-sectional views of a multiple lamp lighting fixture with the center lamp respectively protracted and retracted in accordance with the preferred embodiment of the invention taken along the lines 4—4 of FIG. 2.
Figure 4A:
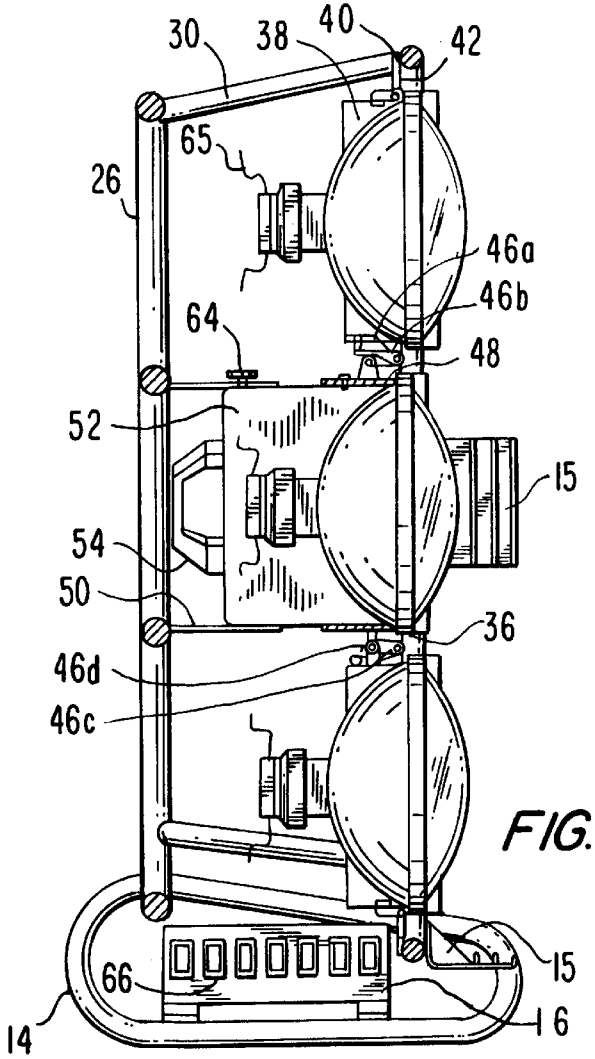
Figure 7B:
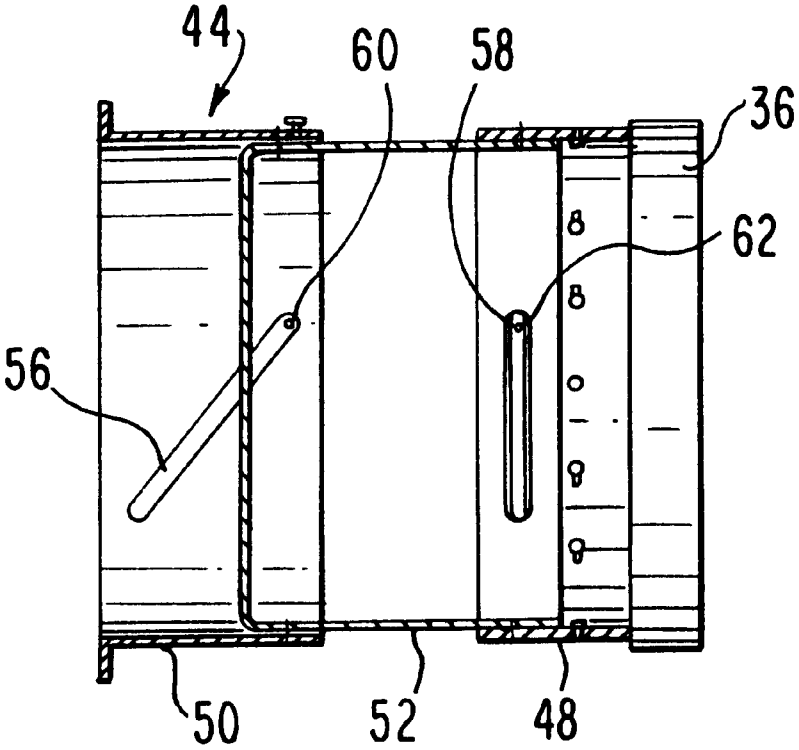
FIGS. 7A and 7B are schematics showing the structure of the center drive assembly respectively retracted and protracted in accordance with the preferred embodiment of the invention shown in FIG. 2.
Figure 7A:
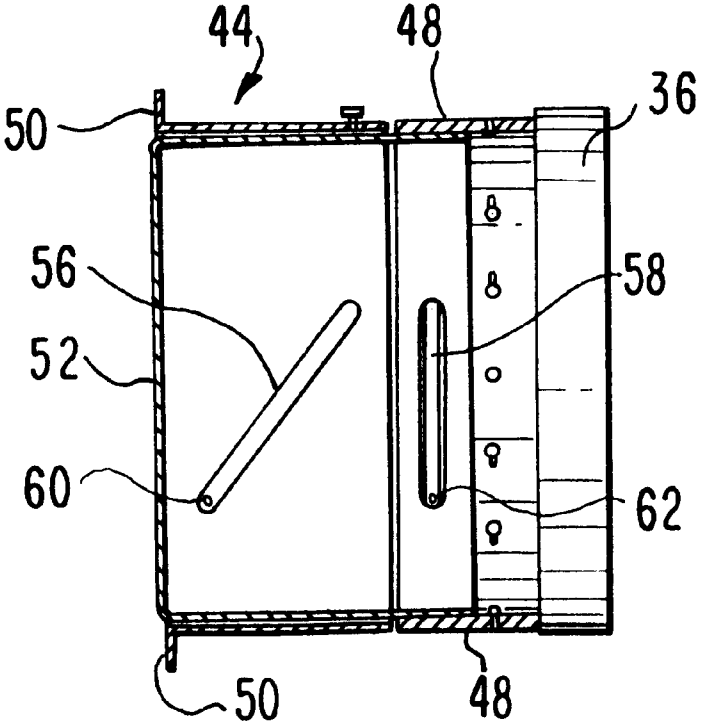

When rotated in the clockwise direction, the center can, housing and hub combination will retract toward the rear of the fixture (FIG. 7A) and, when rotated in the counterclockwise direction, the combination will protract toward the front of the fixture (FIG. 7B). This axial movement of the center drive can 52, central lamp housing 36 and center housing hub 48 causes each of the outer lamp housings 38 to simultaneously pivot on the center housing hinges 46 and the outer housing hinges 42, thereby allowing the outer lamp housings 38 to pivot toward the central lamp housing's 36 central axis in unison when in a retracted setting, as shown in FIG. 4B.

Rotation of the center drive can 52 may be stopped anywhere along the length of the slots 56 in the guide ring, making a plurality of focus settings available to the user. The center drive can 52 may also be locked in place at any focus setting. In a preferred embodiment, one or more of the guide pins 60, 62 is provided with a threaded shaft on its outer surface which may receive a knob 64 having an inner screw thread. When tightened, the knob 64 will apply pressure to the guide ring 50 or central lamp housing 36 and prevent further movement of the center drive can 52.

The number of lamps used in the fixture is not limited to seven, but rather is dependent on the type of lamp used, the spacing between the lamps and the desired size of the fixture.

In the preferred embodiment, the diameter of the main frame's front tubular member 28 is twenty-nine inches to accommodate, without modification, standard commercially available light output modulation accessories, such as scrims, barndoors and CHIMERA®, which are typically used on single lamp fixtures in the entertainment industry. Such accessories are secured to the front of the fixture by sliding them between the four accessory holders 15 spaced twenty-nine inches apart around the periphery of the main frame's front tubular member 28. The holders 15 are deep enough to accommodate several accessories at one time. At least one of the accessories holders 15 should have a hinge allowing it to swing open to permit installation of the accessory and a mechanism for locking the holder in a closed position. The holders should also be strong enough to sustain face down placement of the fixture. These types of light modulation accessories are available in a variety of sizes and multiple lamp lighting fixtures in accordance with this invention may be designed to accommodate any of the commercially available sizes.

Many commercially available lamps may be used in the multiple lamp lighting fixture of the invention. For example, lamps of tungsten, HMI, Xenon or other discharge lamp types may be used. A preferred lamp is a PAR-64 type lamp (up to 1200 Watts maximum) commercially available from many manufacturers and, in particular, the 600, 1000 and 1200 Watt tungsten PAR-64 lamps manufactured, for example, by Osram Sylvania, General Electric and Ushio. The preferred lamp has a spherical beam pattern, however, lamps having an ellipse shaped beam pattern may also be used.

It is desirable to maintain the lamp housings 12 in close proximity while providing sufficient space between the central lamp housing 36 and the outer lamp housings 38 to accommodate the center drive assembly 44 and housing hinges 42, 46. Using the preferred PAR-64 lamps, the spacing between each outer lamp housing 38 and the center lamp housing 36 should be less than nine inches to fit within the preferred 29-inch diameter fixture. The spacing between the fixtures is therefore also dependent on the type of bulb used and the desired fixture diameter.

The lamps are inserted into the lamp housings 12 and retained in the lamp housings by front loading snap-on rings commonly used in the industry. The electrical contact members 65 on the rear end of each lamp are connected to the electrical switch box 16 through a standard recessed 3-pin 100 Amp plug and a sufficient length of electrical cable to allow the lamp to be rotated in the lamp housing for beam control. The fixture requires an AC or DC power source providing 120 or 240 volts depending on the lamp type. A separate switch 66, 67 is provided in the electrical switch box 16 for each lamp. The fixture may be used with one or more of the lamps illuminated by activating the switches corresponding to the desired lamps. The switches shown in the preferred embodiment are rocker-type switches having on and off positions. The fixture may be made dimmable by inserting a 100 Amp input/output dimmer switch in-line between the power source and the electrical switch box 16. Alternatively, each individual lamp may be made dimmable by replacing the rocker switches and electrical connectors with multi-pin connectors and switches capable of controlling the supplied voltage. The switches may also be controlled remotely using conventional stage lighting control boards and connectors.

Figure 8A:
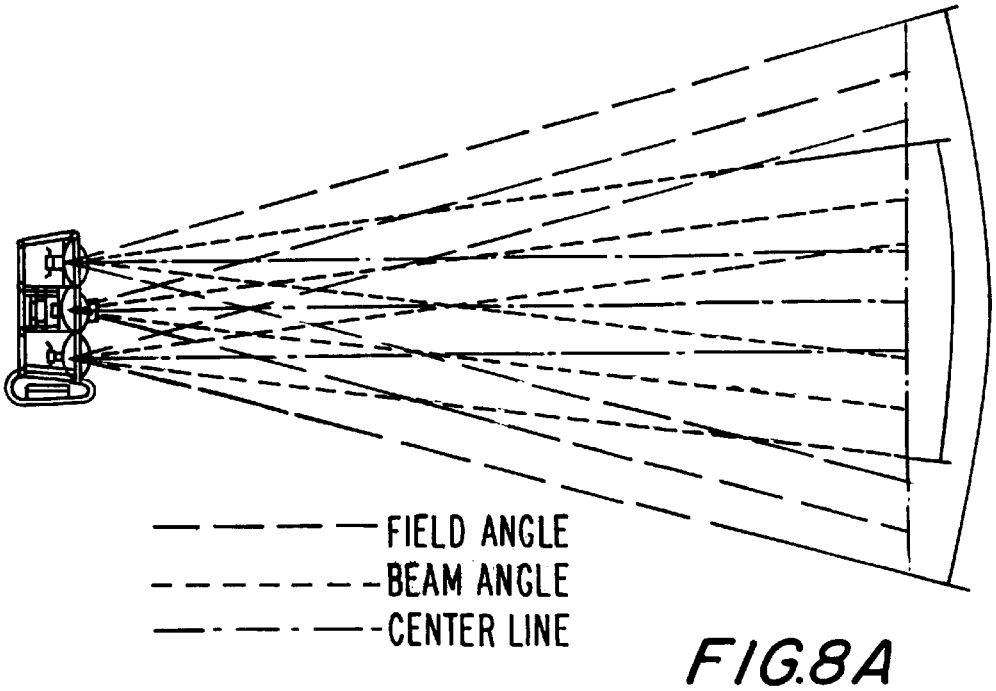
FIGS. 8A and 8B are diagrams showing diametric views of light projection from a multiple lamp lighting fixture with the center lamp respectively protracted and retracted in accordance with the preferred embodiment of the invention shown in FIG. 2.
Figure 8B:
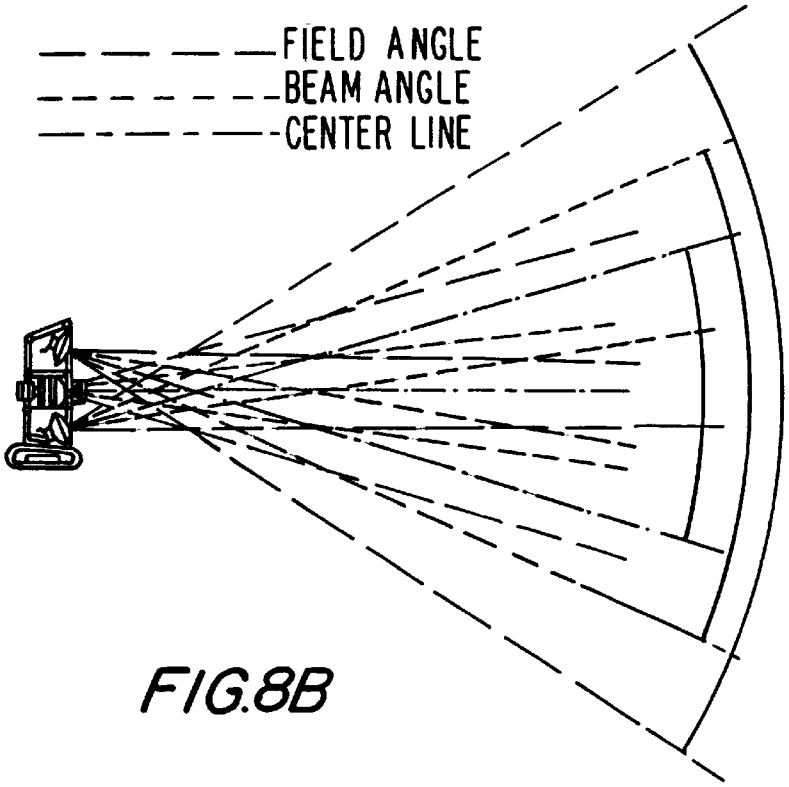

FIGS. 8A and 8B are schematic representations respectively showing the beam patterns output by the multiple lamp lighting fixture of the invention in protracted and retracted settings. Both figures demonstrate that the light beams of all lamps in the outer lamp housings 38 intersect points along the center beam line of the lamp in the central lamp housing. This remains true for all settings between the retracted and protracted settings. FIG. 8A shows that a protracted setting causes the center beam lines of all lamps to be essentially parallel. In FIG. 8B, the maximum retracted setting causes the radial beams to intersect at a distance of approximately sixteen inches measured from the forward most point on the fixture. Other embodiments of different sizes and using different lamps would allow for intersection at a distance less than sixteen inches when retracted and further divergence of the outer lamps' center beam lines when protracted.

By way of example, the operation of one embodiment of the multiple lamp lighting fixture in accordance with the invention will be described. The yoke 18 of the fixture should first be mounted on a supporting structure. Seven switches 66, 67 are located on the electrical switch box 16 for operating each of the seven lamps. Activating the center switch 66 illuminates the center lamp, which may be used to aim the fixture at a given target. The position of the fixture may be adjusted by panning and tilting the fixture in the yoke. The position should then be locked by rotating the yoke's locking arm 24. The convergence point of the outer lamps is then adjusted by illuminating one or more of the outer lamps using switches 67. The focusing handle 54 is then rotated to actuate the center drive assembly 44 as previously described. Through the center drive assembly, the lamp in the outer lamp housings 36 moves in a direction parallel to its center beam axis and simultaneously adjusts each of the lamps in the outer lamp housings 38 in unison to tilt toward the center beam axis. The focusing handle 54 should be rotated until the beams of all of the illuminated outer lamps overlap one another on the selected target. This focused positioned can then be locked in place by tightening the focus locking knob 64 on the center drive assembly 44. Further adjustment of the beam pattern may be achieved by individually rotating each outer lamp to maximize light output from the fixture. The outer lamps may be manually rotated while the lamp is on through the rear end of the tubular frame.

Due to the nature of radial convergence and divergence, the center beam lines of the outer lamps immediately diverge past the focal point. This provides a very wide or narrow spread of the beams as the outer lamps' center beam lines will cross over the center beam at acute or obtuse angles depending on the focal setting. In a completely retracted setting, the convergence point of all beams is close to the fixture and may function as a flood setting for a plane parallel to the fixture at a further distance from the fixture.

The multiple lamp lighting fixture of the invention provides greater light efficiency than commercially available multiple lamp lighting fixtures. Photometric data for the seven lamp preferred embodiment of the invention using four different types of PAR-64 lamps, including candlepower, footcandles and beam size (width x height in feet), is shown in TABLES 1–4:

TABLE 1

LAMP: VNSP/FNN 1000 Watt PAR-64

| Candlepower: | SPOT FOCUS 2,195,069 | | FLOOD FOCUS 481,119 | |
|---|---|---|---|---|
| Distance (feet) | Footcandles | Beam Size | Footcandles | Beam Size |
| 5 | 84105 | 2 × 1 | 30345 | 4 × 4 |
| 10 | 22365 | 4 × 2 | 5565 | 8 × 8 |
| 25 | 3507 | 11 × 5 | 756 | 20 × 20 |
| 50 | 878 | 22 × 10 | 192 | 39 × 39 |
| 75 | 390 | 33 × 16 | 86 | 59 × 59 |
| 100 | 220 | 44 × 21 | 48 | 78 × 78 |

*Footcandles (at distances over 25 ft) = Candlepower/Distance$^2$

TABLE 2

LAMP: NSP/FFP 1000 Watt PAR-64

| Candlepower: | SPOT FOCUS 1,826,300 | | FLOOD FOCUS 394,056 | |
|---|---|---|---|---|
| Distance (feet) | Footcandles | Beam Size | Footcandles | Beam Size |
| 5 | 45255 | 2.6 × 1 | 26250 | 5 × 1.5 |
| 10 | 14490 | 5 × 3 | 3850 | 9.5 × 3 |
| 25 | 2898 | 13 × 7 | 600 | 24 × 7.5 |
| 50 | 731 | 26 × 13 | 160 | 48 × 15 |
| 75 | 325 | 38 × 20 | 70 | 71 × 23 |
| 100 | 183 | 51 × 27 | 40 | 95 × 30 |

*Footcandles (at distances over 25 ft) = Candlepower/Distance$^2$

TABLE 3

LAMP: MFL/FFR 1000 Watt PAR-64

| Candlepower: | SPOT FOCUS 820,838 | | FLOOD FOCUS 266,963 | |
|---|---|---|---|---|
| Distance (feet) | Footcandles | Beam Size | Footcandles | Beam Size |
| 5 | 27510 | 8 × 3.5 | 14490 | 7.8 × 4 |
| 10 | 7560 | 16 × 7 | 2709 | 15.6 × 8 |
| 20 | 1292 | 39 × 17 | 420 | 39 × 205 |
| 50 | 328 | 79 × 33 | 107 | 78 × 41 |
| 75 | 146 | 118 × 50 | 47 | 117 × 61 |
| 100 | 82 | 158 × 67 | 27 | 156 × 82 |

*Footcandles (at distances over 25 ft) = Candlepower/Distance$^2$

TABLE 4

LAMP: WFL/FFS 1000 Watt PAR-64

| Candlepower: | SPOT FOCUS 291,288 | | FLOOD FOCUS 193,953 | |
|---|---|---|---|---|
| Distance (feet) | Footcandles | Beam Size | Footcandles | Beam Size |
| 5 | 10605 | 3.6 × 2 | 9828 | 5 × 3 |
| 10 | 25310 | 7 × 4 | 1953 | 10 × 6 |
| 25 | 441 | 18 × 10 | 305 | 25 × 15 |
| 50 | 117 | 36 × 21 | 78 | 50 × 30 |
| 75 | 52 | 54 × 31 | 34 | 75 × 45 |
| 100 | 29 | 72 × 427 | 19 | 100 × 61 |

*Footcandles (at distances over 25 ft) = Candlepower/Distance$^2$

Although the invention has been described with reference to preferred embodiments, it will be appreciated by one of ordinary skill in the industrial lighting arts that numerous modifications are possible in light of the above disclosure. For example, a multiple lamp lighting fixture having any number of lamps greater than two may be made with minor design modification. Actuators, motors and/or transmitter/receivers, as well as other frame designs, may also be added to create a remotely controlled motorized version of the multiple lamp lighting fixture. Further, the central drive assembly may be used even if the center lamp is removed. For example, it may be desirable in certain applications to have a lamp with no center lamp or with other equipment such as a camera lens in the center of the fixture. All such variations and modifications are intended to be within the scope and spirit of the invention as defined in the claims appended hereto.

We claim:

1. A lighting fixture comprising a plurality of lamps arranged within a housing such that a central hub having a central axis is surrounded by and pivotally linked to a plurality of outer lamps each having an outer beam axis, the outer lamps being pivotally linked to the housing, and a focusing means for simultaneously moving the central hub in a direction along the central axis and causing each of the outer lamps to pivot such that each outer beam axis may be converged on a point along the central axis.

2. A lighting fixture according to claim 1, wherein the housing comprises an open tubular frame which provides easy access to the plurality of lamps.

3. A lighting fixture according to claim 1, wherein the outer lamps are pivotally linked to the central hub via a lever type hinge comprising at least two pivot pins.

4. A lighting fixture according to claim 1, wherein the outer lamps are loosely fixed in the housing to provide for individual lamp rotation.

5. A lighting fixture according to claim 1, further comprising means for removably securing standard light output accessories to a front surface of the housing.

6. A lighting fixture comprising a plurality of lamps arranged within a common housing such that a central hub having a central axis is surrounded by and pivotally linked to a plurality of outer lamps each having an outer beam axis, the outer lamps being pivotally linked to the housing, and a focusing means for simultaneously moving the central hub in a direction parallel to the central axis and causing each of the outer lamps to pivot such that each outer beam axis may be converged on a point along the center axis, wherein the focusing means comprises a cylindrical drive can having a plurality of pins extending from its surface, a first cylindrical guide means mounted to a rear surface of the housing and a second cylindrical guide means mounted to the central hub, the first and second guide means each having a plurality of latitudinal slots therethrough, the slots in the first guide means being perpendicular to the central axis and the slots in the second guide means being inclined with respect to central axis, wherein the drive can is placed between the first and second guides and the pins on the surface of the drive are arranged to slide in the latitudinal slots when the drive can revolves.

7. A lighting fixture according to claim 6, wherein the slots in the second guide means provide motive force for moving the drive can along the central axis.

8. A lighting fixture according to claim 6, wherein the slots in the first guide means maintain a fixed linear relationship between the drive can and the central hub.

9. A lighting fixture according to claim 6, further comprising a focusing handle on a rear surface of the drive can for rotating the drive can in the first and second guide means.

10. A lighting fixture according to claim 6, further comprising a locking means for preventing inadvertent rotation of the drive can when the fixture is focused.

11. A lighting fixture according to claim 10, wherein one of the pins on the drive can is provided with a thread shaft, the locking means comprising a knob having an interior screw thread for engaging the threaded shaft.

12. A lighting fixture comprising:

a lamp housing;

a central hub having a central beam axis movably secured to a central point in the housing, such that the central hub moves in a plane parallel to central axis;

a plurality of outer lamps each having an outer beam axis arranged in close proximity to the central hub and being pivotally linked to the central hub and to the housing; and focusing means attached to the central hub for simultaneously providing motive force to the central hub along the central axis and tilting force to the outer lamps, such that light beams emitted from all of the lamps may be focused in unison on a desired point along the central axis, the focusing means comprising a cylindrical drive can having a plurality of pins extending from its surface, a first cylindrical guide means mounted to a rear surface of the housing and a second cylindrical guide means mounted to the central lamp, the first and second guide means each having a plurality of latitudinal slots therethrough, the slots in the first guide means being perpendicular to the central beam axis and the slots in the second guide means being inclined with respect to central beam axis, wherein the drive can revolves between the first and second guide and the pins on the surface of the drive are arranged to slide in the latitudinal slots.

13. A lighting fixture according to claim 12, wherein the slots in the second guide means provide motive force for moving the drive can along the central beam axis and the slots in the first guide means maintain a fixed linear relationship between the drive can and the central lamp.

14. A lighting fixture according to claim 12, wherein one of the pins on the drive can is provided with a thread shaft, the lighting fixture further comprising a knob having an interior screw thread for engaging the threaded shaft to provide a locking means for preventing inadvertent rotation of the drive can when the fixture is focused.

15. A lighting fixture comprising a plurality of lamps arranged within a common housing such that a central hub having a central axis is surrounded by and pivotally linked to a plurality of outer lamps each having an outer beam axis, the outer lamps being pivotally linked to the housing, and a focusing means for simultaneously moving the central hub in a direction parallel to the central axis and causing each of the outer lamps to pivot such that each outer beam axis may be converged on a point along the central axis, the fixture further comprising a center lamp having a center beam axis aligned with the central axis of the central hub.

16. A lighting fixture according to claim 15, wherein the central and outer lamps are selected from the group consisting of tungsten, HMI, Xenon and other discharge type lamps.

17. A lighting fixture comprising:

a lamp housing;

a central hub having a central beam axis movably secured to a central point in the housing, such that the central hub moves in a direction along the central axis;

a plurality of outer lamps each having an outer beam axis arranged in close proximity to the central hub and being pivotally linked to the central hub and to the housing; and focusing means attached lo the central hub for simultaneously providing motive force to the central hub along the central axis and tilting force to the outer lamps, such that light beams emitted from all of the lamps may be focused in unison on a desired point along the central axis.

18. A lighting fixture according to claim 17, wherein each of outer lamps is individually rotatable.

19. A lighting fixture comprising:

a lamp housing;

a central hub having a central beam axis movably secured to a central point in the housing, such that the central hub moves in a plane parallel to central axis;

a center lamp having a center beam axis aligned with the central axis of the central hub;

a plurality of outer lamps each having an outer beam axis arranged in close proximity to the central hub and being pivotally linked to the central hub and to the housing; and focusing means attached to the central hub for simultaneously providing motive force to the central hub along the central axis and tilting force to the outer lamps, such that light beams emitted from all of the lamps may be focused in unison on a desired point along the central axis.

20. A lighting fixture according to claim 17, wherein the housing comprises an open tubular frame which provides easy access to the plurality of lamps, and the lamps are loosely fixed in the housing to provide for individual lamp rotation.

21. An apparatus for simultaneously moving a central lamp having a central beam axis in a direction parallel to the central beam axis and adjusting a beam angle of a plurality of outer lamps pivotally linked on one side to and concentrically arranged around the central lamp and pivotally linked on an opposing side to a housing, comprising a cylindrical drive can having a plurality of pins extending from its surface, a first cylindrical guide means mounted to a rear surface of the housing and a second cylindrical guide means mounted to the central lamp, the first and second guide means each having a plurality of latitudinal slots therethrough, the slots in the first guide means being perpendicular to the central beam axis and the slots in the second guide means being inclined with respect to central beam axis, wherein the drive can revolves between the first and second guides and the pins on the surface of the drive are arranged to slide in the latitudinal slots.

* * * * *